US005239922A

United States Patent [19]

Zimmer

[11] Patent Number: 5,239,922

[45] Date of Patent: Aug. 31, 1993

[54] APPARATUS AND METHOD FOR APPLICATION OF A FLUID TO A WEB

[76] Inventor: Johannes Zimmer, Ebentaler Str. 133, A-9020 Klagenfurt, Austria

[21] Appl. No.: 659,285

[22] PCT Filed: Jul. 31, 1990

[86] PCT No.: PCT/AT90/00077

§ 371 Date: Apr. 11, 1991

§ 102(e) Date: Apr. 11, 1991

[87] PCT Pub. No.: WO91/02650

PCT Pub. Date: Mar. 7, 1991

[30] Foreign Application Priority Data

Aug. 16, 1989 [AT] Austria ..... 1943/89

[51] Int. Cl.[5] ..... B41L 13/04

[52] U.S. Cl. ..... 101/120; 101/129; 118/414

[58] Field of Search ..... 101/114-116, 101/119-124, 129, 489; 118/258, 262, 213, 414, 119, 419, 406, 106

[56] References Cited

U.S. PATENT DOCUMENTS 3,974,766 8/1976 Zimmer ..... 101/129
4,516,495 5/1985 Ericsson ..... 101/129

FOREIGN PATENT DOCUMENTS 0081476 6/1983 European Pat. Off. .
0311728 4/1989 European Pat. Off. .
0311743 4/1989 European Pat. Off. .

*Primary Examiner*—Edgar S. Burr
*Assistant Examiner*—Ren Yan
*Attorney, Agent, or Firm*—Herbert Dubno

[57] ABSTRACT

An apparatus and a process for printing, coating or dyeing of webs of material including an application element applying the substance to and magnetically pressed against the web or the stencil, the position of the element is manually set during experimental or short yardage production to the desired values and these values are maintained in the large-scale production, the application element is movably mounted on a support beam so that a distance and angular position with respect to the support beam are modified and controlled.

22 Claims, 5 Drawing Sheets

APPARATUS AND METHOD FOR APPLICATION OF A FLUID TO A WEB

CROSS REFERENCE TO RELATED APPLICATIONS

This application is a national phase of PCT/AT90/00077 filed Jul. 31, 1990 and based, in turn, upon Austrian National Application A 1943/89 of Aug. 16, 1989 under the International Convention.

FIELD OF THE INVENTION

The present invention relates to a process for applying a liquid to a web of material and, more particularly, to a method and apparatus for coating, printing or dyeing of webs of material wherein the printing or the coating is manually set to the desired values during a short yardage production and the positions thus selected are maintained, further, during a large-scale production.

BACKGROUND OF THE INVENTION

In practice there is a great variety of requirements when performing finishing, —printing or full-surface application processes on a web of material. Some of these requirements stemming from differences regarding the quality of the goods and the technological requirements, as well as from differences in the lengths of material to be produced.

In the textile finishing industry, there are production runs in which only very small lengths of material have to be produced, such as prints for neckties. There are also production runs where the orders amount to a few hundred meters, as well as large orders, each amounting to several thousand or tens of thousands of meters, which are to be produced with the same application results.

For instance one of the basic requirements in the textile printing practice is the so-called sampling of a new design in various color combinations, each on the shortest possible pieces of material. As a rule, from a great number of such short sample pieces some are selected as a basis for large orders.

In practice, considerable difficulties are encountered in the conversion process from these samples produced on,small length of material to a large-scale production to date there are no installations and methods which can fully meet the existing requirements.

OBJECTS OF THE INVENTION

It is the object of the present invention to eliminate the drawbacks characteristic to the prior art. Still another object of the present invention is to provide the coating process achieving a general improvement in the quality of pattern-printing and full-surface finishing application on a web of material.

SUMMARY OF THE INVENTION

Among the difficulties existing now in the conversion from small-scale, or sample production to large-scale production, two of them have to be particularly pointed out, i.e. the techniques of dye and substance supply and the contact with the web referred to as the doctor blade technique.

When short sample pieces are produced in case of smallest-scale and small-scale production, it is usually, required to bring the printing paste manually to the application station, i.e. the doctor blade device. In the case of large-scale production, automatic supply systems are used. The situation is similar when it comes to doctor blade devices for sampling purposes and to small-scale production. For the purposes of quicker handling and shorter resetting times, simple, manual application devices are preferred. In the large-scale production machines, doctor devices are used which are more cumbersome to handle or attach, and as to mechanical mounting and precise adjustment. The aforedescribed differences in the supply of dyes and in the doctor blade technique have almost always serious consequences on the quality of the printing or finishing result.

Frequently, the practitioner has a lot of trouble in converting the selected, sample pieces into large-scale production,and yet preserving all quality criteria true to the sample. Often, all dye concentrations, dye viscosities and doctor blade adjustments have to be newly worked out for the large-scale production, since the critical parameters for the printing cannot be transferred. The calculation of the new parameters is very work-intensive and time-consuming and very uneconomical, due to the interruptions in the production process which result. Most of the time, the trials to establish ways to reach results which are true to the sample also cause considerable loss in goods and application substances. A relatively high percentage of rejects and low-quality production result.

Many printing, or finishing plants even give up the technically and economically valid idea of producing small samples, by using their expensive large-scale production facilities also for sampling purposes, in order to avoid the aforementioned conversion problems (although this approach is not profitable).

In accordance with the invention, it is possible to use even in large-scale production machines with manually actuatable dye supply arrangements, which are simpler to operate and clean.

In short, the method according to the invention offers the following possibilities of transfer, or reproducibility:

1. Reproducibility, or transferability with the same installation or the same embodiment, e.g. for repeated orders and so-called coloring changes (printing with the same stencil but with different colors);

2. Transferability of manual setting to mechanized or automated setting;

3. Transferability of the setting by "swivelling" to the setting by "distance change";

4. Transferability of the "manual dye supply"to operation a "dye or substance supply by mechanical or automated means";

5. Transferability with simultaneous multiple work process resetting, e.g. of manual setting by rotating the axis and manual substance supply to automatic setting and angular setting by a distance modification and with automatic substance supply.

Compared to the state of the art, such transfers of settings and results are new.

When with large-scale production machines samples or small-scale production prints have to be made, which is very important and also is frequently required in practice, within a highly colored design of, for instance, ten stencils, only three to five stencils operate on large surfaces and therefore have a correspondingly large, automatically controlled dye consumption. The other five to seven stencils print only a small fraction of the design and therefore have only minimal dye consumption. The dye supply system of the invention can lead to a considerable improvement of the process economy. The dye and substance delivery simplified according to the invention results also in savings of resetting time and of water since the cleaning of pumps and pipes requires very large amounts of water.

For patterns with manual delivery systems, the respective dye paste or substance can be prepared precisely according to requirements, so that there are no losses. The resulting savings amount to an average of 51/stencil and color positions. The manually actuated delivery device makes also possible the cleaning of the stencils and optionally of the doctor blade device in the built-in state. The dye vat used last is extracted and then a new vat filled with cleaning water is slid in, a short rinse with the rotating stencil follows and then a vat with fresh dye is inserted for the next color position During sampling, several different colors can be printed next to each other at the same time, by inserting slidable partitions in the vat. By affixing a rod to such a slidable partition wall, it can be used as a slide plate for cleaning the vat, thereby saving dye and water.

Up until now, not only application devices operating with mechanical pressure, but also the devices working under the action of magnetic force have been built as resistant to bending as possible. This is valid for the upper part of the device, such as a support beam to which the actual doctor blade element is mounted, as well as for the actual doctor blade holder, e.g. doctor blade bars in connection with doctor rollers. As noted above, highly bending-resistant constructions were considered desirable for doctor blade devices. However, the apparatus according to the invention is built so that for the construction of the doctor blade bars or the doctor blade holding bars, a bendable material is used. This approach results in the favorable effect of fitting the profiled, bar to the doctor blade element and of fitting the former elements together to the application surface or stencil.

Up to now it was customary to determine the positioning of the axis of the doctor blade element by the structure of the doctor blade device. According to the invention, the axial position of the doctor blade element is determined exclusively by magnetic force applied thereto, i.e. the doctor blade element is responsive to the magnetic field and is not rigidly connected with the doctor blade bars, defining, thereby, only an angular position of the doctor blade bar with respect to the application surface. Since during the determination of the position of the doctor blade only small amounts of material are used, there are no big losses and it is possible to perform a quick cleaning without long interruptions when the stencils are changed. Also, the setting can be done only with a single stencil device, although the stencils known per se work in succession when a long web of material is processed. The setting values found during sampling only with the aid of a single drum-type screen printing device can be easily transferred to the individual pattern printing stations. In most of the known apparatuses, not only the position of the doctor roller, seen in the direction of travel, is determined by a mechanical device, but also the axial position of the doctor blade element transverse to the direction of travel by the doctor blade arrangement.

In doctor blade devices which operate under the action of magnetic force, the magnetic force is used as the pressure force and in some cases also as a subordinated auxiliary force which determines the positioning of the blade, but this happens always in cooperation with mechanical means specifically arranged for positioning of the blade. The present invention proposes for the first time to use the magnetic force not only for the function of pressing the doctor blade but also for a second main work function, namely to use magnetic force alone without help of any mechanical means. The axial position of a magnetically operated doctor blade or spreading rod is also determined in response to the applied magnetic force.

Furthermore, the device according to the invention is characterized in, that the doctor blade element held exclusively by magnetic force a further nonmagnetizable or only partially magnetizable component which, in cases where the doctor blade element is a roller, is swivellable together with the doctor element about its axis or in other instances, about its application edge.

According to the invention, three work functions are assigned to the magnet force, respectively to the technical magnetic component of the device according to the invention:

1. the usual pressure upon the doctor blade element, the positioning of the doctor blade with respect to the application surface, and 2. positioning and holding of an additional work component, which is connected to form a single component with the doctor blade element or the doctor blade edge.

The connection parts built according to the invention, which mechanically contribute to the fastening of the magnetically held work components to the machine or which connect superimposed parts, have, during the operational stage, only the control function of determining the angular position of the profiled rod swivellable around alone or together with the doctor blade element with respect to the web.

In accordance with the invention, these connection parts controlling the angular position by sliding contact have also a holding function. This function is never effective during operation, but only when the apparatus does not operate. This secondary holding function, which neither can be put into effect nor is permitted to become effective during the operational stage has as a result that the entire application installation—wherein the substance delivery system is also integrated—can be handled as a single component. This facilitates the mounting and dismounting of the installation and during the mounting of the doctor blade element makes possible to set the approximately suitable position for the desired magnetically operational stage under the action of magnetic force and also to lift the doctor blade installation (in the contactless position with respect to the application surface or stencil) during short-term interruptions in the operation or when the magnetic field is disconnected.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
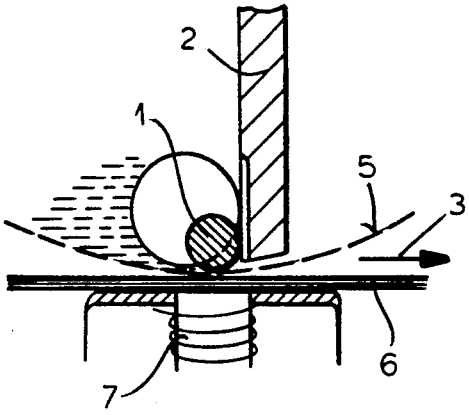
FIG.1 PRIOR ART
FIGS. 1–3 are cross sectional views of prior art doctor devices.
Figure 2:
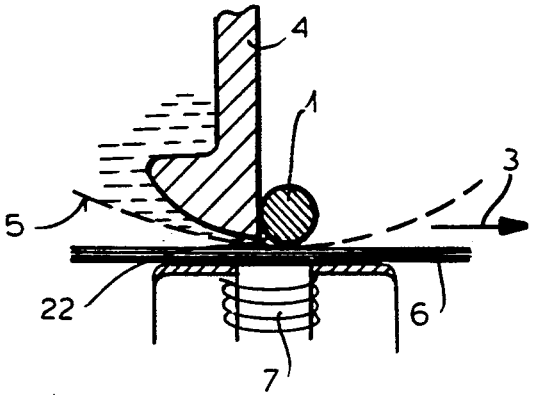
FIG.2 PRIOR ART
Figure 3:
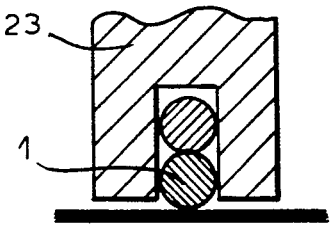

Three of the known magnetic doctor blade devices with auxiliary means are shown in FIGS. 1 to 3. FIG. 1 shows a magnetically operated doctor roller 1 having a support bar 2 which is arranged after the roller 1 seen in the direction of travel 3, and supports either the roller 1 or the dye or paste roll or both.

FIG.. 2 shows the so-called dye-collecting bar 4, or dye-collecting and sealing bar seen in the travel direction 3 and arranged in the area upstream of the doctor roller 1 and the dye 22 or paste in front of the roller. As seen, the dimension and position (distance from the, application plane, from the stencil 5 of the web 6) of the bar has a certain influence on the application process.

A further known magnetically operated doctor blade device according to FIG. 3 shows a double roller arrangement in a cage 23.

This known state of the art in FIGS. 1 to 3 has two disadvantages:

1. these devices are available only in two-component construction, which compared to the single-component type requires twice as much handling; and 2. the doctor rollers are in danger of bending and therefore harder to handle, this danger increases with the reduction of the diameter and with the increase of their length (i.e. work width).

These drawbacks affect the balance so heavily that in practice most of the users of these devices never use rollers with diameters under 10 mm, although for certain application requirements doctor rollers of 8 mm or 6 mm—sometimes even 4 mm —would be technologically appropriate.

This causes some users to select doctor blade devices of another construction or to acquire various machinery and devices resulting in further expenses and operational disadvantages.

Figure 4:
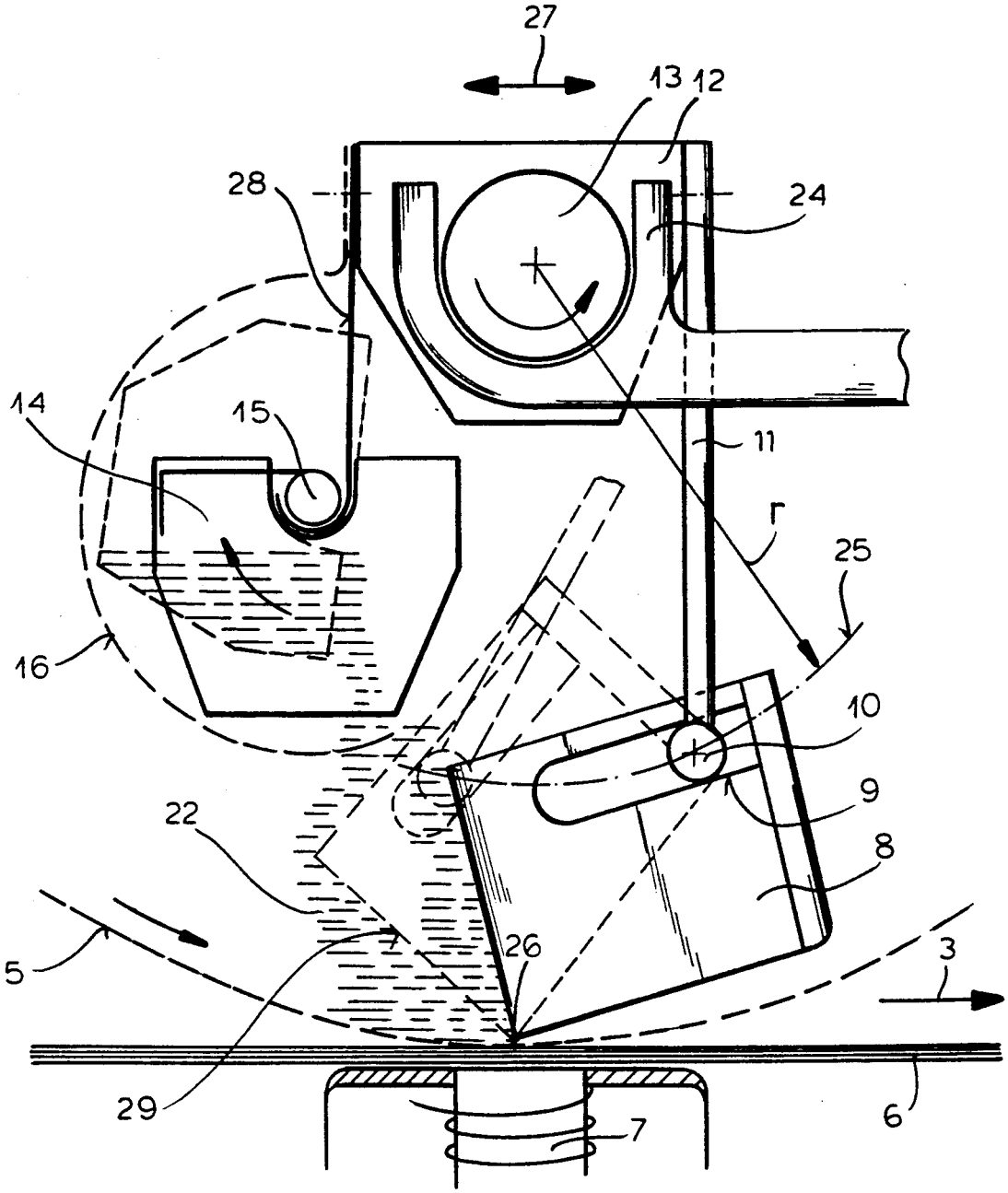
FIG. 4 is a cross section of an apparatus according to the present invention.

In FIG. 4 it is shown that the positioning of the doctor blade is determined and maintained solely by a magnetic force applied thereto. Here, the doctor blade element 8 has a guide 9, wherein an adjustment pin 10 is slidably arranged. This adjustment pin 10 is held by a connection element 11 which is connected to the support beam 12. This support beam 12 has a trapezoidal cross section and carries at its ends round axle-end pivots 13. These axle-end pivots 13 rest on rounded supports 24. By rotating the support beam 12 in the axle-end pivot support 24, the connection element 11 and therewith the adjusting pin 10 are lifted and lowered and moved along a circular path 25. This tilts the doctor blade element 8 about the application edge 26. A second position of the doctor blade element 8 is shown in broken lines.

It can be easily seen that as a result the angle of the doctor blade element ,8 with respect to the stencil 5 or the web 6 which are pressed against the magnetic table 7, is also modified. As an alternative to twisting the support beam, the swivelling of the doctor blade element 8 can also be achieved by horizontal displacement in the direction of arrow 27.

For the supply of the substance to be applied, a vat 14 is provided which can be suspended from a rail 28. The vat can also be tilted about the axis 15 or guided along the concave wall 16 shown in broken lines. Due to this tilting of the vat, the application substance 22 can be, brought in front of the doctor blade element 8. At a certain relative position between the adjusting pin 10 and the guide 9, the doctor blade element 8 is swivelled as already mentioned, thereby setting into action a work surface 29 which exerts a pressure upon the application substance 22.

Figure 5:
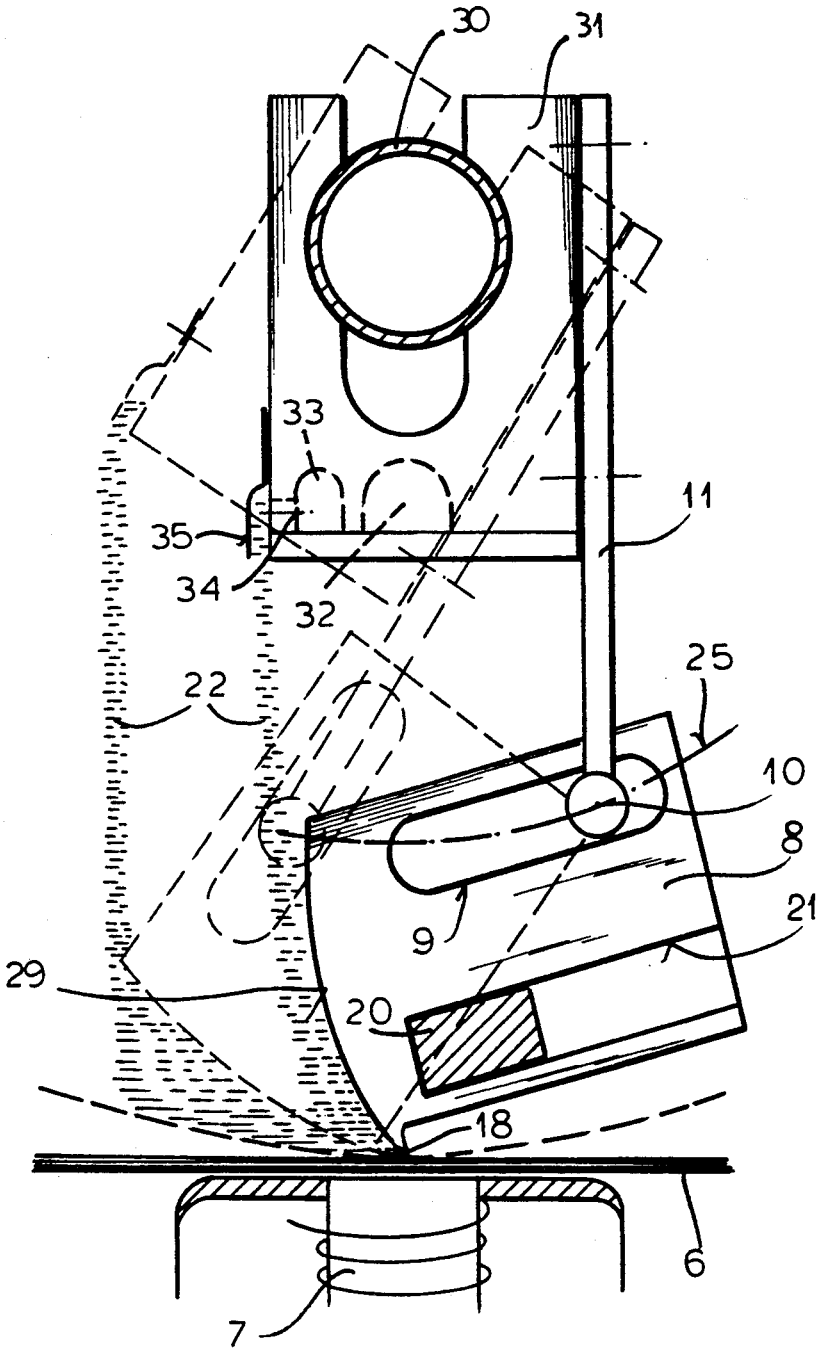
FIG. 5 is a cross section of still another embodiment of the apparatus according to the invention.

In FIG. 5, an embodiment similar to the one in FIG. 4 is shown, however here the surface 29 oriented against the stencil 5 or the web 6 is curved and a doctor edge 18 is formed on the swivel edge. The doctor blade element 8 consists here of a nonmagnetizable material, but in a slot 21 a magnetizable bar 20 is inserted, so that through the magnetic table 7 the doctor edge 18 can be pressed against the stencil 5 or the web 6. Compared to FIG. 4, the substance delivery system is here differently designed. The swivel axle is here designed as a pipe 30 and inserted in a profiled body 31. In the profiled body 31 there is a main channel 32 connected with pipe 30, the end of this channel connects with a further channel 33, from whence the substance to be applied then exits through bores 34. Additionally, a rebound or deflecting ledge 35 can be provided.

Figure 6:
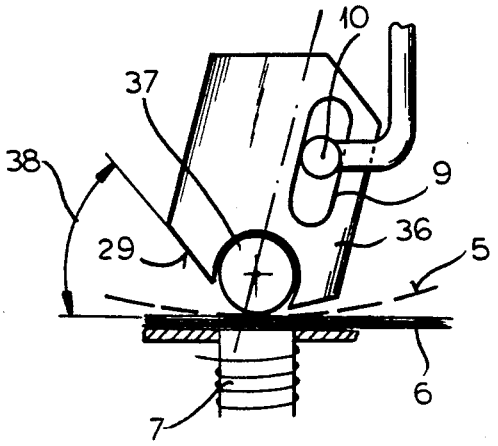
FIG. 6 is a cross section of a profiled doctor blade holding bar in one position thereof.

In FIG. 6, in a bar 36 again a guide 9 is provided, wherein the adjusting pin 10 is movably arranged at the connection element. The actual doctor blade element is here a roller 37 which is magnetically pressed against the web of material. The surface 29 serves again for the exertion of pressure upon the medium to be applied. At a large angle 38 between the so-called collecting (accumulation) surface 29 of the bar 36 and the application surface 6 or the stencil 5, a minimal application takes place.

Figure 7:
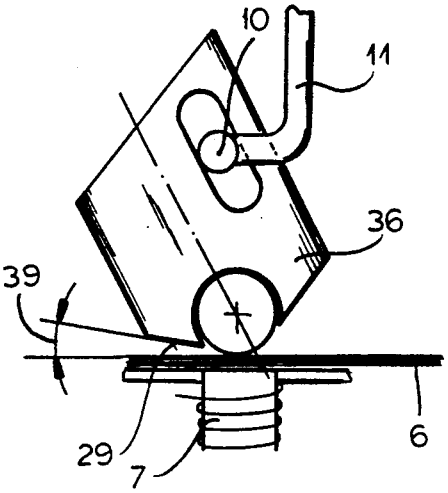
FIG. 7 is a cross section of the holding bar identical to that illustrated in FIG. 6 but shown in a different position.

In FIG. 7, another work position is shown. However, here a small angle 39 between the accumulation surface 29 of bar 36 and the application surface 6 or stencil is selected, whereby the maximal application output is achieved.

Figure 8:
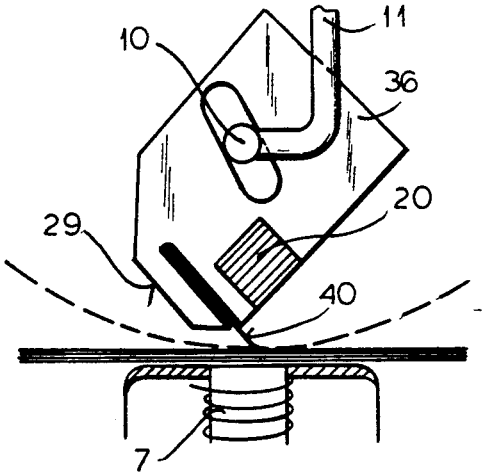
FIG. 8 is a cross section of a holding bar for an elastic doctor blade according to the invention.
Figure 9:
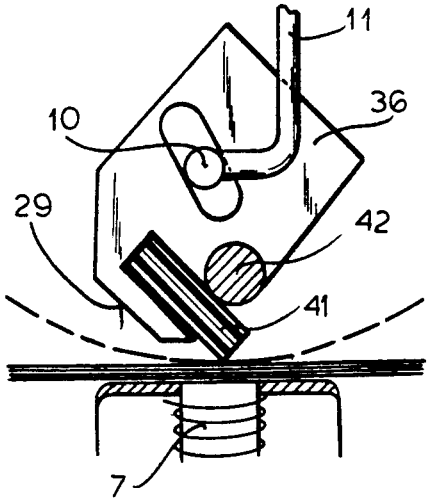
FIG. 9 is a cross section of still another embodiment of the holding bar for the elastic blade according to the invention.

In FIG. 8, a further embodiment is represented, but here the doctor blade element is formed by a doctor blade 40 and in the bar 36 a further bar 20 of magnetizable material is provided According to FIG. 9, the doctor blade element is formed by a pressure-resilient body 41 and the magnetizable mass 42 consists of a cylindrical rod resting against the pressure-resilient body 41.

Figure 10:
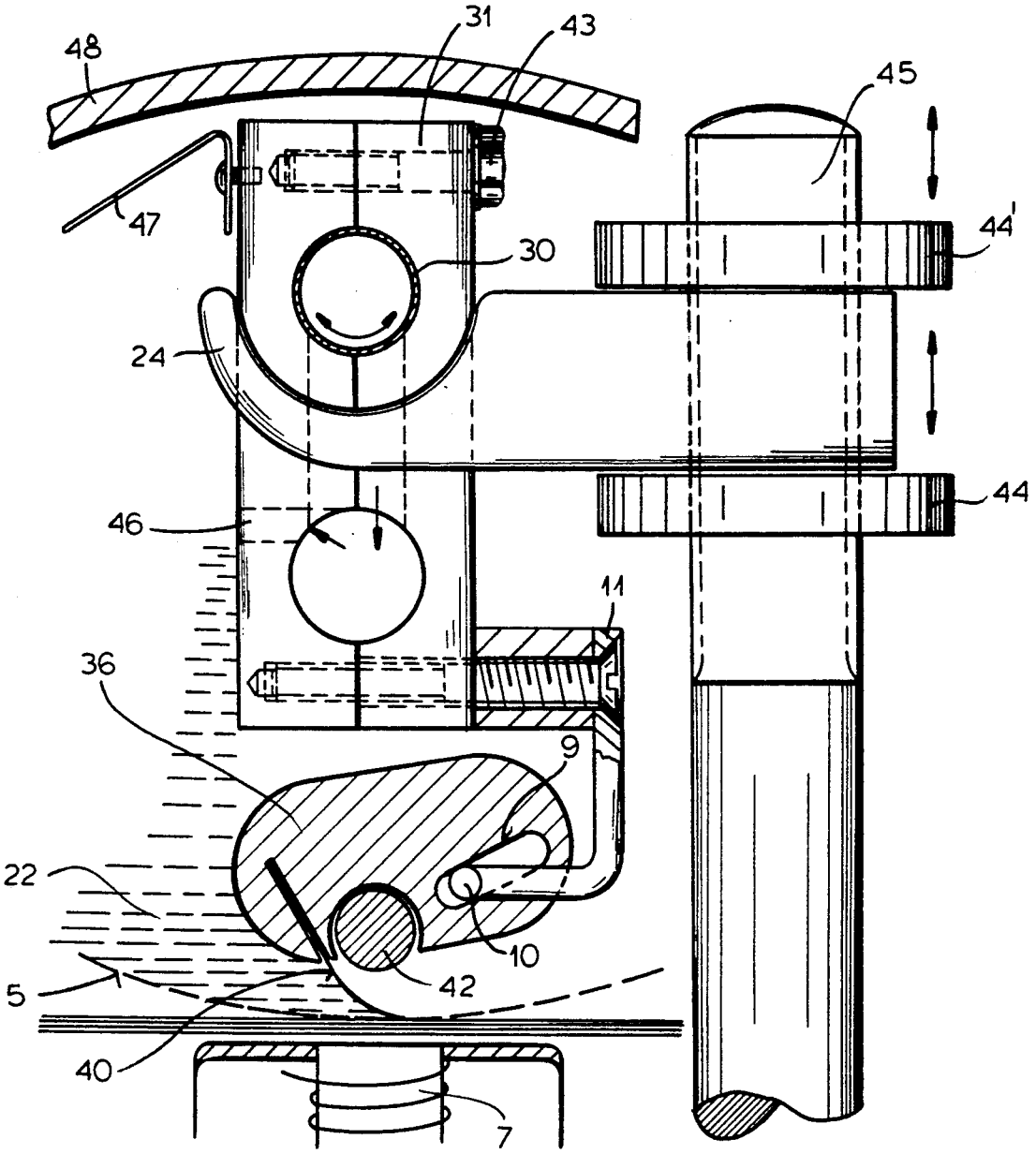
FIG. 10 is a cross section of yet another embodiment of the apparatus, according to the invention.

The embodiment of the invention according to FIG. 10 is similar to the one of FIGS. 4 and 5. The tubular axle 30 with the profiled body 31 which is clamped thereto in two parts and held together by for instance screws 43 can be rotated, or the mounting support 24 can be height-adjusted by actuating setting nuts 44 and 44' on a threaded bar 45. For the dye discharge, a groove 46 is provided, whereby the dye discharge can take place partially or continuously horizontally or can be directed diagonally downwards. The height adjustment can also be performed by an electromotor via the threaded bar 45. When the installation is dismounted, it stands on the head and the profiled body 31 rests on a support shell 48 and a drain 47 is provided for the discharge of the residual dye.

Figure 11:
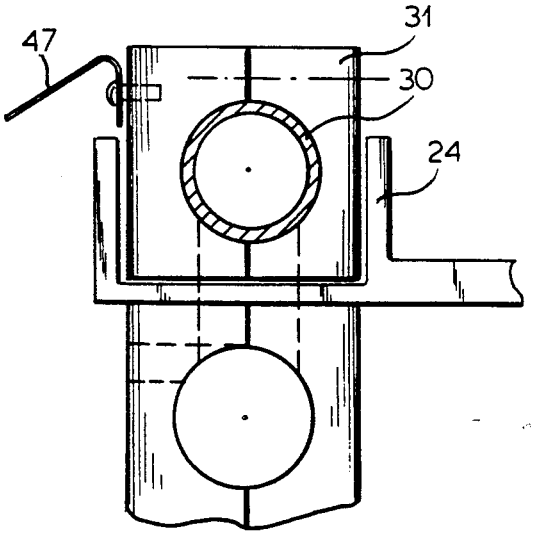
FIG. 11 is a cross section of a rectangularly shaped mounting support with a profiled holding bar.

FIG. 11 is a rectangularly shaped mounting support 24 with a profiled body 31 of the same configuration. Such an embodiment can be used when the swivelling possibility can be dispensed with.

Figure 12:
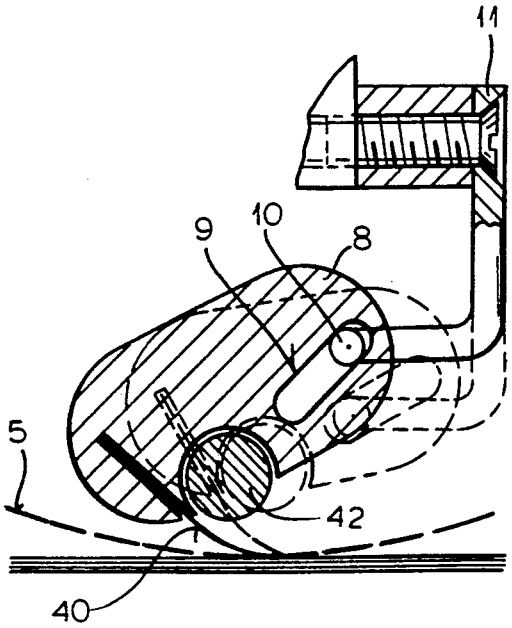
FIG. 12 is a cross section of the holding bar of the apparatus illustrated in FIG. 4 and shown in different angular positions.

FIG. 12 shows once more the bottom part of FIG. 4 in different angular positions (once in full lines and once in broken lines), which are given by the different height setting of the adjusting pin on the connection element 11.

In both embodiments variants, the apparatus of the invention can perform in practice as follows by a) manual dye delivery, or b) dye delivery by means of a pump, pipe, distribution device and optionally automatic control.

The variant (a) is particularly economical when used in sampling and small-scale production machines, the variant (b) is to be preferred for large-scale production machines. Furthermore, the variant (a) can also be used in large-scale production, namely advantageously in connection with such stencils which print only very small details of a pattern and as a result have a minimal printing dye or application substance consumption. For instance, in a large-scale production machine with for instance ten drum-type printing stencils stations, five can be equipped with variant (a) and the other five with the variant (b). One of the most important advantages of the installation according to the invention consists in the fact that the doctor blade devices of the aforedescribed variants (a) and (b) have exactly the same application characteristics and also have the same kind of adjustability, so that not only each of variants (a) and (b) can be set to have the same reproducible results, but that it is also possible to transfer application values reached during sampling with the devices of variant (a) to the devices of the variant (b) and to reproduce this results during production.

As can be seen from the aforedescribed advantages, the present invention is of great importance from the economic point of view.

In addition it has to be mentioned that the doctor blade devices together with the angular-position adjusting devices are so mounted that the manually or electromechanically established setting values can be fed to the computer of an automated production installation equipped with the doctor blade devices of the invention. This advantage is also of great technical and economic importance.

In the embodiment with the doctor blade holding bar equipped with a doctor roller it has proven advantageous to provide the surface of the doctor roller with a structure.

To build a doctor roller with a structured surface and to support it continuously in a guide similarly to a slide bearing appears almost as nonsensical and against all rules of machine construction techniques.

However, it has been proven by tests that when the optimal dimensions for the diameters, respectively for the interrelationship of diameters and mutually suitable match of material are selected, embodiments of this type are viable. For example, it is possible to achieve a better adherence of the dye paste or of the substance to be applied at the doctor roller. As a result, the entrainment of a larger quantity of substance into the effective application contact area is achieved, also the structuring of the roller surface enhances the capability to entrain the traces of application substance remaining on the roller once the application has been completed as well as their entrainment through the gap or contact area existing between the roller surface and the slide-bearing-like guide.

During swivelling of the support beam about its longitudinal axis the translation of the angle at which the beam swivels with respect to angular displacement of the doctor blade is 1:1 to 1:4.

In conclusion, it has to be said that through this additional, in itself unusual step of the invention an improvement of the application process as well as an increase in operational safety are achieved.

The invention is not limited to the illustrated examples, particularly it is possible to adjust the doctor blade element not by means of a sliding joint connection, but to subject it separately to a translational, respectively rotational movement, and generally to perform only a change in its positioning.

I claim:

1. An apparatus for applying a flowable substance to a web, comprising:

means for generating a magnetic field disposed along one side of a web to be coated with a flowable material;

a support beam spaced from said web on an opposite side thereof;

a bar member juxtaposed with said opposite side of said web, subjected to said magnetic field and comprised at least in part of magnetically attractable material whereby said bar is drawn toward said web and has a surface provided with a tapered portion which forms an angle with said web converging in a direction of travel of said web and with which said flowable material is applied to said web, said bar member being formed with a doctor element pressing said flowable material against said web;

a holder member connecting said bar member with said beam;

a slide-joint connection swivelably mounting said bar member on said holder member, said slide-joint connection including a slot formed on one of said members and a pin on the other of said members slidably engaged in said slot;

means for displacing said holder member to vary an angular position of said bar member swivelable about an axis of said pin and about a line substantially corresponding to a line at which said element presses said flowable substance against said web upon displacement of said holder member, said means for displacing includes means for varying a distance between said beam and said doctor element, whereby said angular position of said bar member and said distance are substantially translatable for short yardage and large yardage applications.

2. The apparatus defined in claim 1 wherein said holder member is slidable by said means for varying in a direction parallel to said web.

3. The apparatus defined in claim 1 wherein said means for varying includes means for rotating said support beam about an axis thereof.

4. The apparatus defined in claim 1 wherein said means for varying includes means for shifting said support beam parallel to itself and to said web.

5. The apparatus defined in claim 1 wherein said means for varying includes means for rotating said holder member about an axis of said beam.

6. The apparatus defined in claim 1 wherein said doctor element is a roller.

7. The apparatus defined in claim 6 wherein said roller is received in a groove formed in said bar member.

8. The apparatus defined in claim 1 wherein said doctor element is a bar with a profiled edge.

9. The apparatus defined in claim 1 wherein said doctor element is a resilient bendable blade.

10. The apparatus defined in claim 1 wherein said bar member has a body of nonmagnetizable material and formed with a recess receiving a rod of magnetizable material.

11. The apparatus defined in claim 1, further comprising a trough for delivering said flowable material mounted on said support beam.

12. The apparatus defined in claim 11, further comprising means for mounting said trough on said beam for pivoting of said trough about an axis on said beam.

13. The apparatus defined in claim 11, further comprising means for mounting said trough on said beam for swinging of said trough along a shell on said beam.

14. The apparatus defined in claim 1 wherein said support beam is formed with a supply pipe for said flowable substance, said supply pipe having openings distributed over a length thereof.

15. The apparatus defined in claim 1, further comprising a cylindrical stencil rotatable between said doctor element and said web, said beam being provided with supply means for feeding said flowable material to said doctor element, said supply means extending beyond said stencil for refilling of said supply means during operation of said stencil.

16. The apparatus defined in claim 1 wherein said members are dimensioned so that, upon angular displacement of said support beam, said bar member is angularly displaced in a ratio therewith of 1:1 to 1:4.

17. A process for applying a flowable material to a web, comprising the steps of:

(a) generating a magnetic field from one side of a web to which the flowable material is to be applied;

(b) magnetically attracting a bar member provided with a doctor element toward an opposite side of the web, thereby swiveling the bar member on a holder member connecting the bar member with a beam spaced from the web at a slide-joint connection swivelably mounting said bar member on said holder member, said slide-joint connection including a slot formed on one of said members and a pin on the other of said members slidably engaged in said slot so that said bar member can swing about an axis of said pin;

(c) applying the flowable material between said bar member and the web;

(d) manually displacing the holder member so that said bar member pivots about an application line at which said doctor element applies said flowable material most effectively to said web, thereby varying an angular position of said bar member with respect to said web;

(e) simultaneously with step (d) varying a distance between said beam and said doctor element, thereby establishing the angular position of said bar member and the distance between said beam and said doctor element for application of a given flowable material to a sample of the web; and (f) transferring said settings for large-scale application of the flowable material to large yardage webs.

18. The process defined in claim 17 wherein said settings are transferred to an automatically controlled machine for application of the flowable material to large yardage webs.

19. The process defined in claim 17 wherein said settings are established in part by angularly rotating said beam to displace said holder member.

20. The process defined in claim 17 wherein said settings are established in part by linearly shifting said beam parallel to itself to displace said holder member.

21. The process defined in claim 17 wherein said flowable material is applied manually in step (c) for coating of web samples and is delivered automatically upon application of the flowable material to large yardage webs following step (e).

22. An apparatus for applying a flowable substance to a web, comprising:

means for generating a magnetic field disposed along one side of a web to be coated with a flowable material;

a support beam spaced from said web on an opposite side thereof;

a bar member juxtaposed with said opposite side of said web, subjected to said magnetic field and comprised at least in part of magnetically attractable material whereby said bar is drawn toward said web and has a surface provided with a tapered portion which forms an angle with said web converging in a direction of travel of said web and with which said flowable material is applied to said web, said bar member being formed with a doctor element pressing said flowable material against said web;

a holder member connecting said bar member with said beam;

a slide-joint connection swivelably mounting said bar member on said holder member, said slide-joint connection including a slot formed on said bar and a pin retained within said slot and movable therein to vary a distance between said beam and said doctor element; and means for displacing said holder member to vary an angular position of said bar member about an axis of said pin.

* * * * *